United States Patent [19]

Wiese

[11] Patent Number: 4,997,165

[45] Date of Patent: Mar. 5, 1991

[54] SAFETY RAIL FOR COLLAPSIBLE BLEACHERS

[76] Inventor: Harold Wiese, N. Highland, P.O. Box 236, Madison, S. Dak. 57042

[21] Appl. No.: 234,817

[22] Filed: Aug. 19, 1988

[51] Int. Cl.[5] ..... E04H 3/12

[52] U.S. Cl. ..... 256/59; 256/73; 52/9; 52/183

[58] Field of Search ..... 52/9, 183; 256/59, 65, 256/67, 24, 73; 182/106, 78; 403/109

[56] References Cited

U.S. PATENT DOCUMENTS

| | | | |
|---|---|---|---|
| 3,401,918 | 9/1968 | Wiese | 256/59 |
| 3,964,215 | 6/1976 | Hartman et al. | 52/9 |
| 3,995,832 | 12/1976 | Wiese | 256/59 |
| 4,006,564 | 2/1977 | Wiese | 52/9 |
| 4,030,255 | 6/1977 | Hartman | 52/9 |
| 4,361,991 | 12/1982 | Wiese | 52/183 X |
| 4,406,347 | 9/1983 | Stathopoulos | 52/183 X |
| 4,513,938 | 4/1985 | Seymour | 403/109 X |
| 4,571,895 | 2/1986 | Lyman, Jr. | 52/183 X |
| 4,640,211 | 2/1987 | Namur | 403/109 X |
| 4,690,383 | 9/1987 | Batcheller | 256/73 X |

*Primary Examiner*—Peter M. Cuomo

*Attorney, Agent, or Firm*—Burd, Bartz & Gutenkauf

[57] ABSTRACT

A collapsible bleacher safety railing for use in conjunction with collapsible bleacher assemblies which are well known and in common use. The railing includes vertical upright support members on which are mounted telescoping hand rail sections therebetween and which include safety panels mounted between the support members below the hand rail. The safety panels eliminate the need for multiple guard rails or comparable guard members and extend and collapse with the bleacher assembly. In one form of the invention, the top edge of the planar safety panel may replace the telescoping hand rail. The vertical support members are preferably angle bars positioned to nest together upon collapse of the bleacher. An improved form of safety hand rail is disclosed.

19 Claims, 7 Drawing Sheets

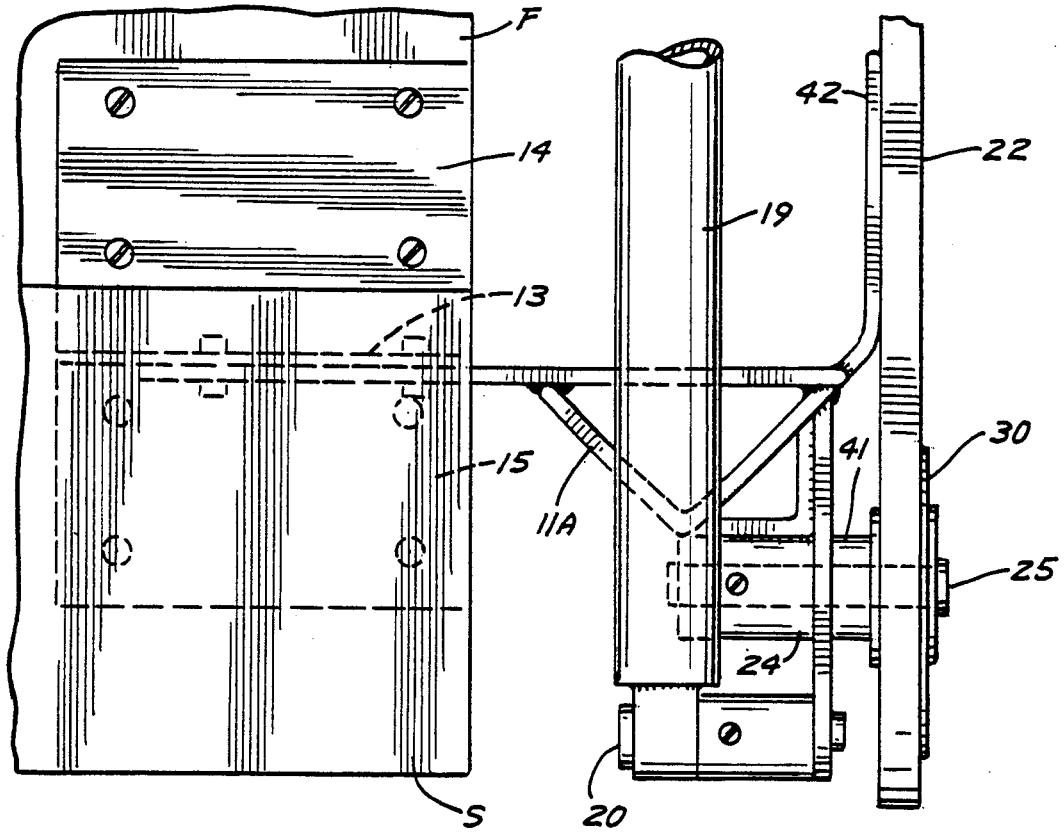
FIG. 9
FIG. 10
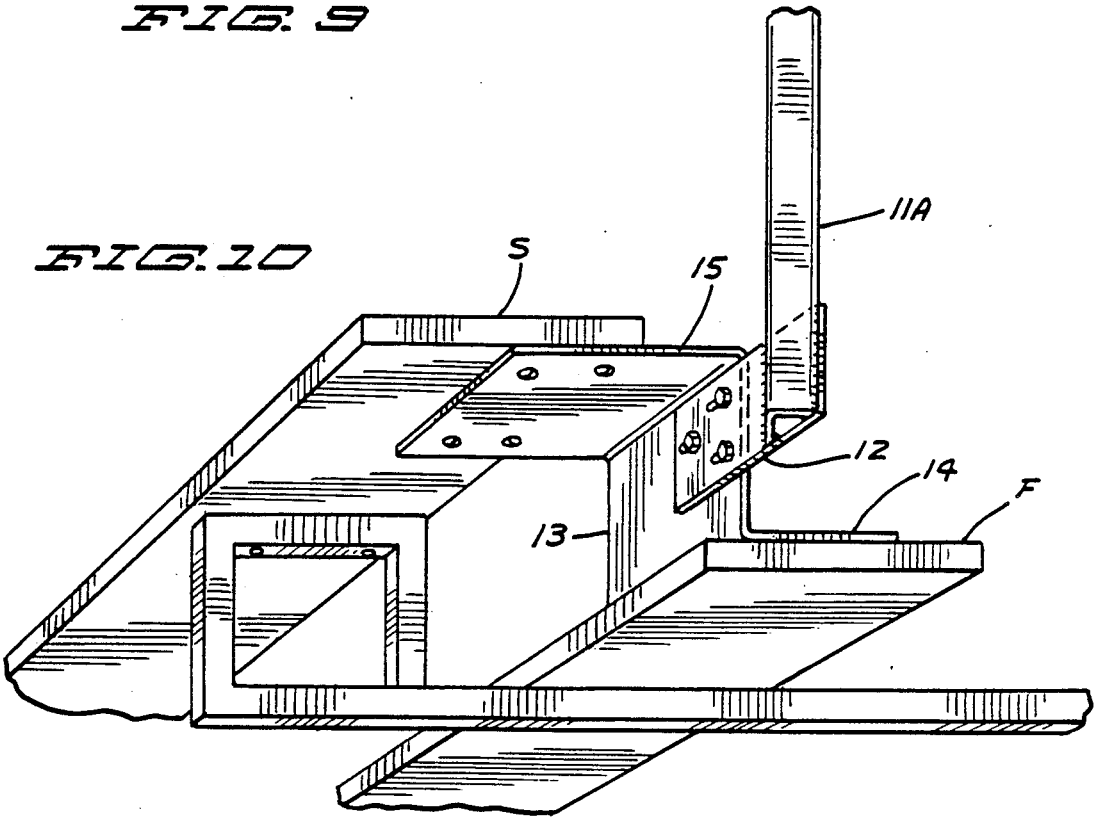

25
26
16
17
18
19
20
21
50
50A
51
52
53
54
55
5
11A
12

SAFETY RAIL FOR COLLAPSIBLE BLEACHERS

FIELD OF THE INVENTION

1. Background of the Invention

This invention relates to safety rails or hand-holds for collapsible bleachers or folding seating sections of the type in common use in gymnasiums, auditoriums, and the like. Collapsible bleachers are designed for relatively compact storage against a wall when not in use. It is advantageous that the stored bleachers occupy the minimum amount of space. Increasingly stringent safety codes require adequate protection against any person falling from the end of a bleacher in use. The present invention is directed to an improved hand rail structure occupying minimum space while providing enhanced protection against accidental falls.

2. The Prior Art

The prior art is represented by applicant's prior U.S. Pat. Nos. 3,401,918; 3,995,832, and 4,006,564 and Hartman U.S. Pat. Nos. 3,964,215 and 4,030,255. In the structures of each of these patents, a telescoping hand rail is provided with one or more telescoping guard rails or other guard means supported below the hand rails and between vertical support posts.

SUMMARY OF THE INVENTION

Broadly stated, the safety rail for a collapsible bleacher according to the present invention includes at least a pair of parallel spaced apart generally vertical support members or posts. The lower ends of these support members are attached to the ends of the collapsible bleacher in ascending spaced relation at the opposite ends of the bleacher A multi-sectional telescoping hand rail is pivotally connected to the top end of each of the support members In the preferred form of the safety rail, a rigid planar safety panel is supported by the vertical support members below the telescoping hand rail and means are provided permitting relative movement between the safety panel and support members upon collapse and extension of the bleachers. In one form of the invention, the top edge of the planar safety panel may replace the telescoping hand rail. The vertical support members are preferably angle bars positioned to nest together upon collapse of the bleacher. An improved form of safety hand rail is disclosed.

BRIEF DESCRIPTION OF THE DRAWINGS

The invention is defined by the drawings in which corresponding parts are identified by the same numerals and in which:

FIG. 1 is a side elevation of a foldable bleacher in extended position;

FIG. 9 is a fragmentary top view generally on the line 9—9 of FIG. 3 and in the direction of the arrows;

FIG. 10 is a perspective view from the bottom showing means of attachment of the hand rail vertical support members to the bleacher structure;

FIG. 11 is a side elevation, similar to FIG. 1, showing the bleacher partially collapsed;

FIG. 14 is a side elevation of an improved multi-sectional telescoping hand rail;

FIG. 15 is a longitudinal section on the line 15—15 of FIG. 14 and in the direction of the arrows;

FIG. 16 is a section on a further enlarged scale on the line 16—16 of FIG. 15; and FIG. 17 is a perspective view of a railing bushing.

DETAILED DESCRIPTION OF THE PREFERRED EMBODIMENT

Figure 2:
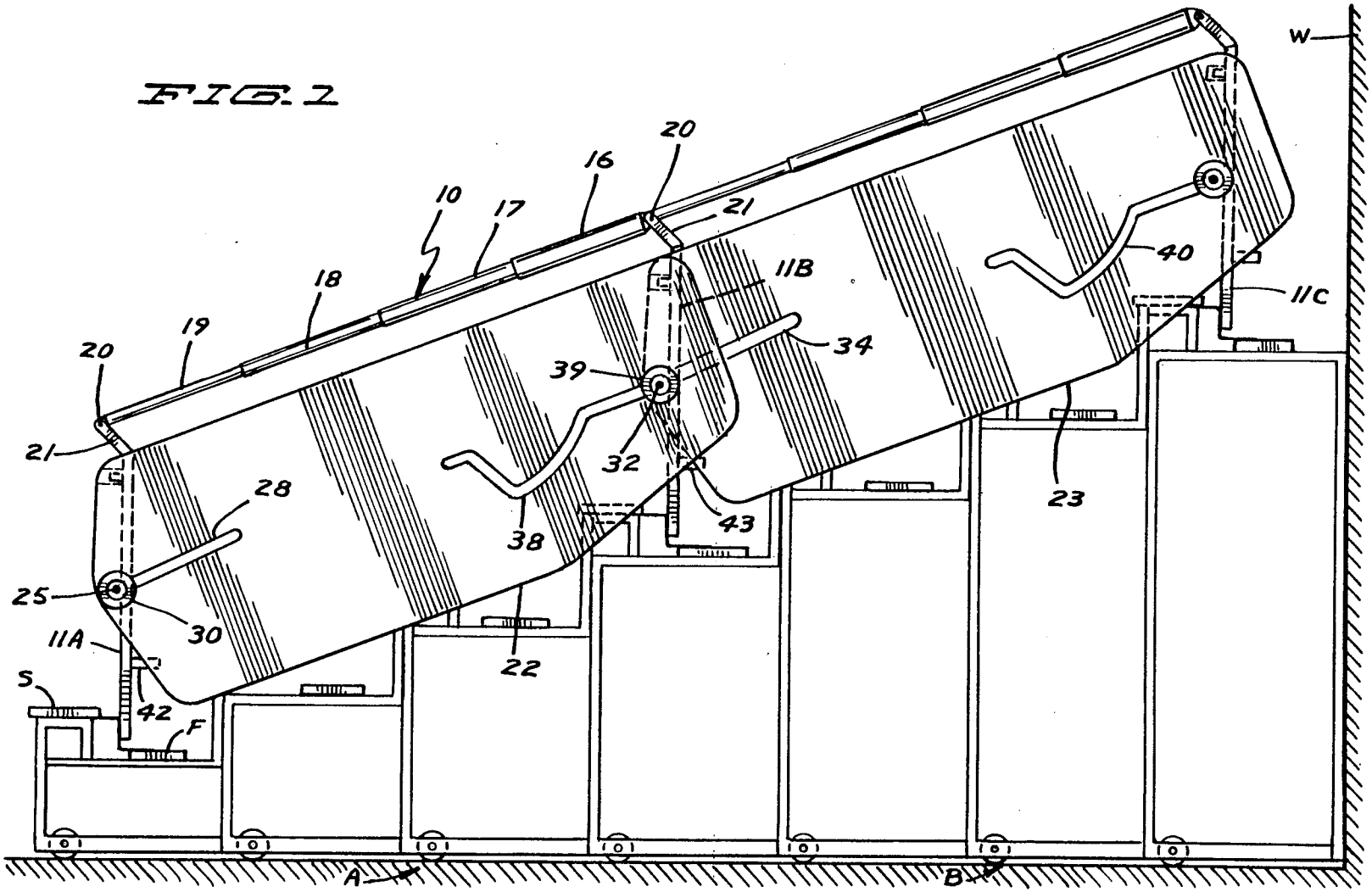
FIG. 2 is a partial front elevation thereof.
Figure 2:
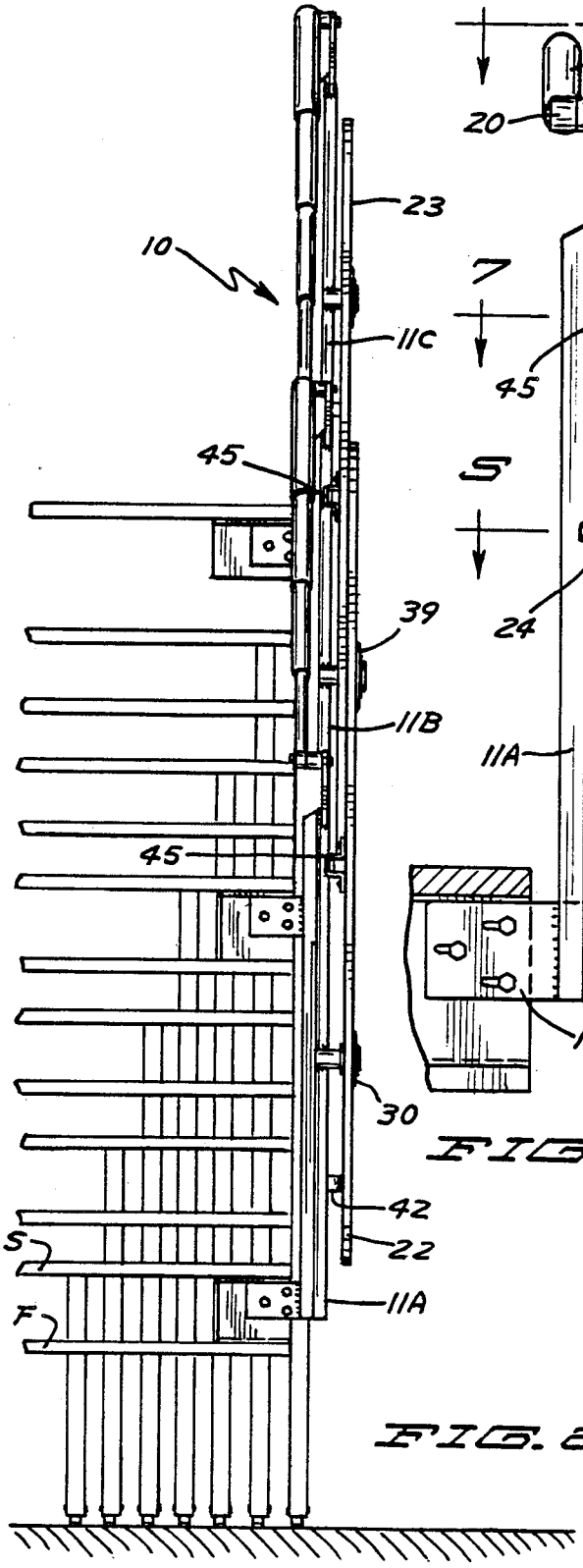
Figure 3:
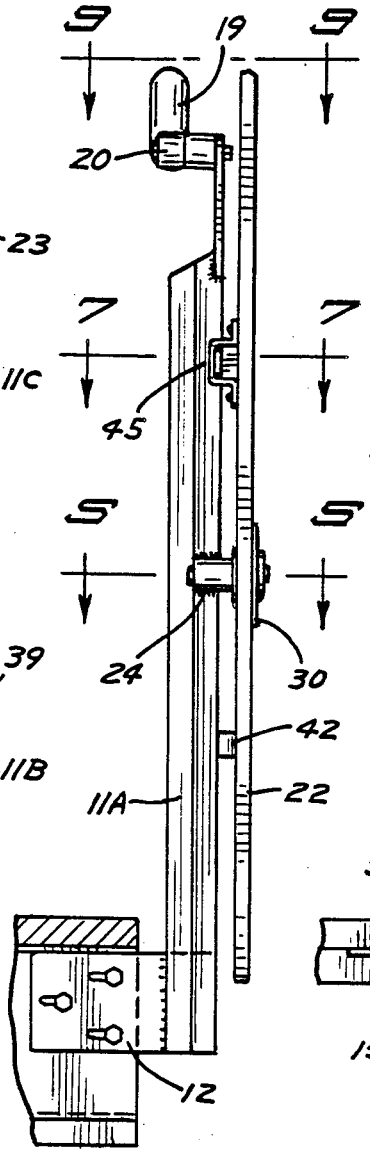
FIG. 3 is a fragmentary front elevation on an enlarged scale showing the lowermost hand rail vertical support.
Figure 4:
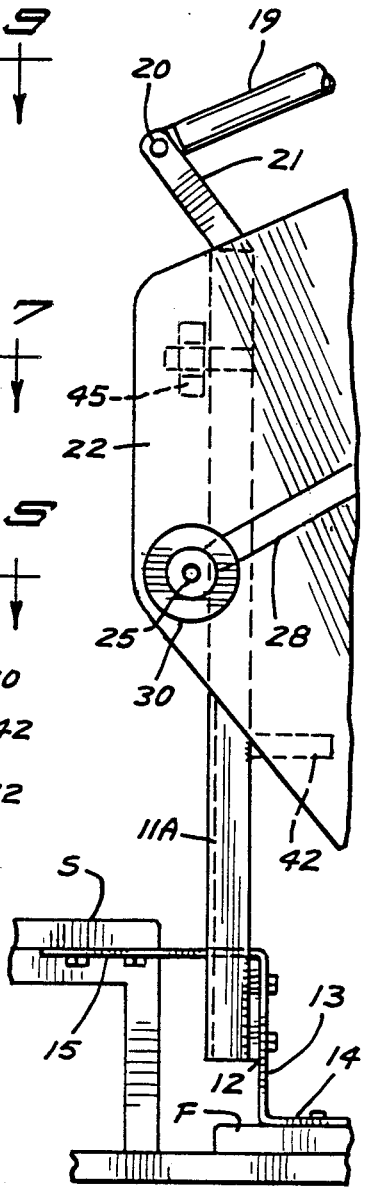
FIG. 4 is a fragmentary side elevation thereof.

The basic bleacher structure and basic hand rail structure and support means are generally as described and illustrated in applicant's prior U.S. Pat. No. 3,995,832, the disclosure of which is incorporated herein by reference. As in that patent, the entire hand and guard rail structure is designated generally at 10 and is shown as applied to a seven row bleacher made up of sections designated A and B. It is to be understood, however, that the structure of the present invention is applicable to a foldable or collapsible bleacher of any height and number of rows.

As seen, each bleacher row includes a seat S and foot rest section F For a neater appearance when collapsed, a riser may be provided at the front edge of each seat. The bleacher is generally located as close to a gymnasium or arena wall W as possible to accommodate the folding and unfolding action of the bleacher.

The hand and guard rail section 10 includes a plurality of vertical support members 11A, 11B, 11C, etc. spaced ascendingly along the bleacher section, and means for mounting these vertical sections 11 best illustrated in FIGS. 9 and 10. A flat plate 12 is welded or otherwise rigidly secured to the bottom end of vertical support member 11. Plate 12 is secured, as by nuts and bolts or equivalent fastening means, to the upright member 13 of a Z-plate whose bottom horizontal member 14 is secured, as by means of screws or equivalent fastening means, to a foot rest section F and whose top horizontal member 15 is secured to the under side of the seat S of the next lower bleacher row.

Typically a vertical support member 11 is provided for every third row of seats. Thus vertical support member 11A is secured to the seat of row 1 and the foot rest of row 2, member 11B is secured to the seat of row 4 and the foot rest of row 5, etc. As illustrated throughout, the vertical supports 11 are preferably formed from angle bar stock as described in greater detail hereinafter, but the particular shape of the vertical supports may be formed from tubular round and square material and the like, as desired.

As described in greater detail hereinafter, each hand rail segment is composed of multiple telescoping sections 16–19. Each end of the hand rail is pivotally connected at 20 to a forwardly offset locating ear 21 provided at the top of each vertical support member 11.

The locating ear 21 is in the form of a laterally and upwardly directed support bracket As described in my aforesaid U.S. Pat. No. 3,995,832, the telescopic hand rails collapse or extend along with the collapse or extension of the bleacher assembly of which they form a part.

Figure 5:
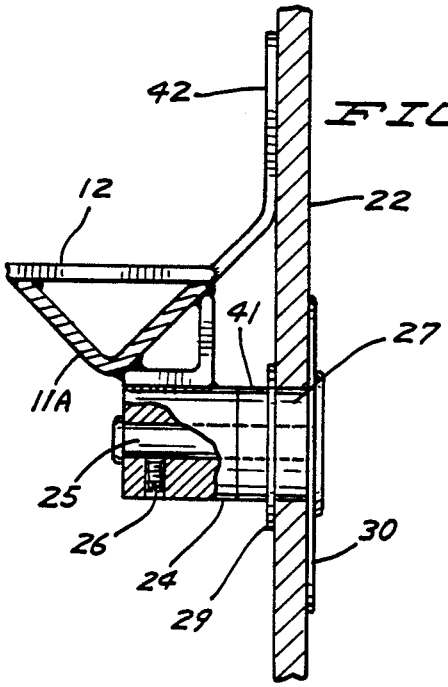
FIG. 5 is a transverse horizontal section on a further enlarged scale on the line 5—5 of FIG. 3 and in the direction of the arrows.

In order to eliminate the need for additional guard rails below and parallel to the hand rails, rigid planar safety panels 22 and 23 are provided mounted below the hand rails between the vertical support members 11 for relative movement therewith as the bleachers are collapsed or extended. As best seen in FIG. 5, the lower end of panel 22 is mounted on vertical support 11A. A hub 24 is welded or otherwise rigidly secured to support member 11A about midway between its ends. A pin 25 is fixed within the hub, as by an Allen screw 26. A roller 27 journaled for rotation on pin 25 is positioned within a longitudinal cam slot 28 in panel 22. Roller 27 is held in place in slot 28 between washer 29 and retainer disc 30.

Figure 6:
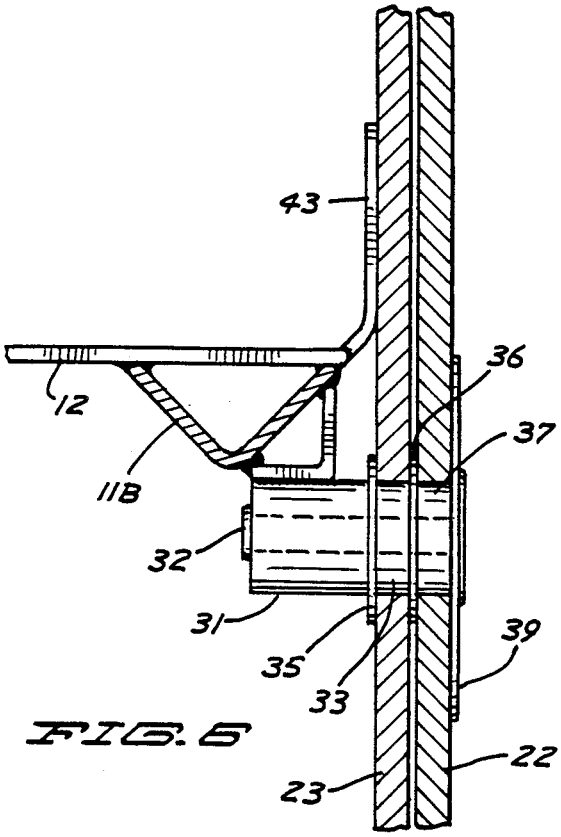
FIG. 6 is a corresponding transverse horizontal section of the second vertical support.

As seen in FIG. 6, the upper end of panel 22 and the lower end of panel 23 are similarly mounted on vertical support 11B. A hub 31 fixed to the vertical support carries pin 32 fixed in the hub. Pin 32 in turn carries roller 33 held in cam slot 34 of panel 23 between washers 35 and 36. Pin 32 also carries roller 37 held in V-shaped cam slot 38 of panel 22 between washer 36 and retainer disc 39. The upper end of panel 23 and the next adjacent safety panel are similarly mounted on vertical support 11C, and so on depending upon the height of the bleacher assembly.

Spacer 41 on pin 25 assists in maintaining proper spacing of panel 22 relative to vertical support 11A and the rest of the assembly Spacer glide arms 42 and 43 mounted on vertical supports 11A and 11B, respectively, also assist in maintaining proper spacing between the panels and vertical supports and lend stability to the assembly. The panels bear against the vertical face surfaces of the arms and slide relative to them during the collapsing and extension operations.

Where codes permit, the telescopic hand rails may be omitted. The safety panels may be of greater width and the top edge of the panel may function as a hand rail.

The safety panels may be formed from any available rigid sheet material of sufficient strength and rigidity. Desirably, however, the panels are formed from a transparent synthetic resinous material, such as methylmethacrylate, commonly available under the trademark Lucite.

Figure 7:
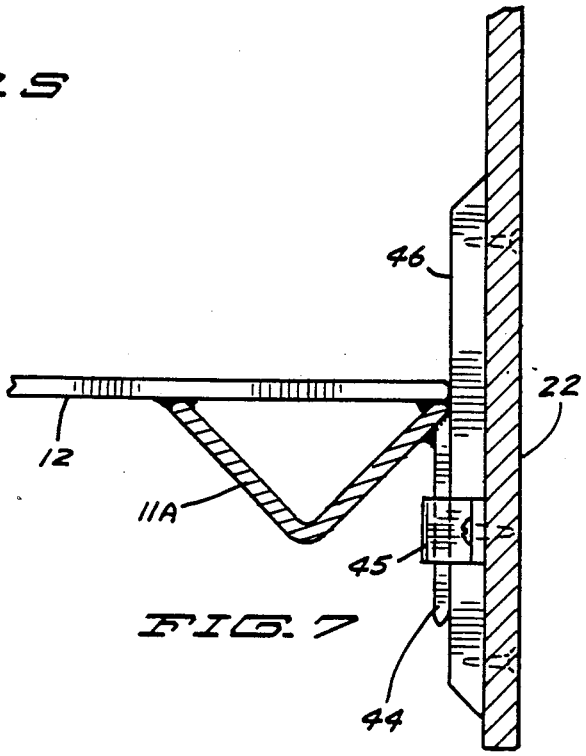
FIG. 7 is a transverse horizontal section on an enlarged scale on the line 7—7 of FIG. 3 and in the direction of the arrows.
Figure 8:
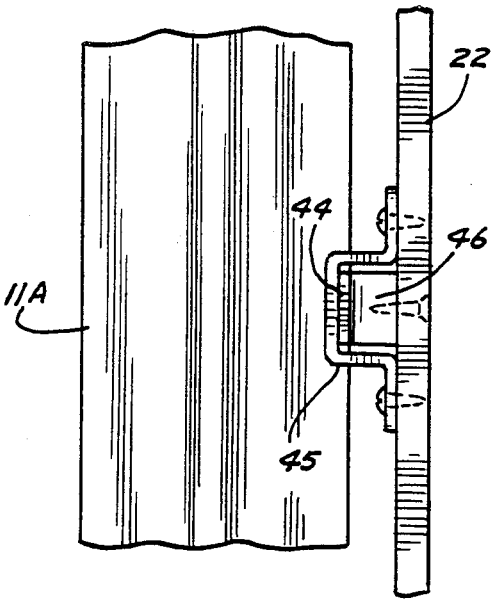
FIG. 8 is a fragmentary front elevation of the structure of FIG. 7.
Figure 22:
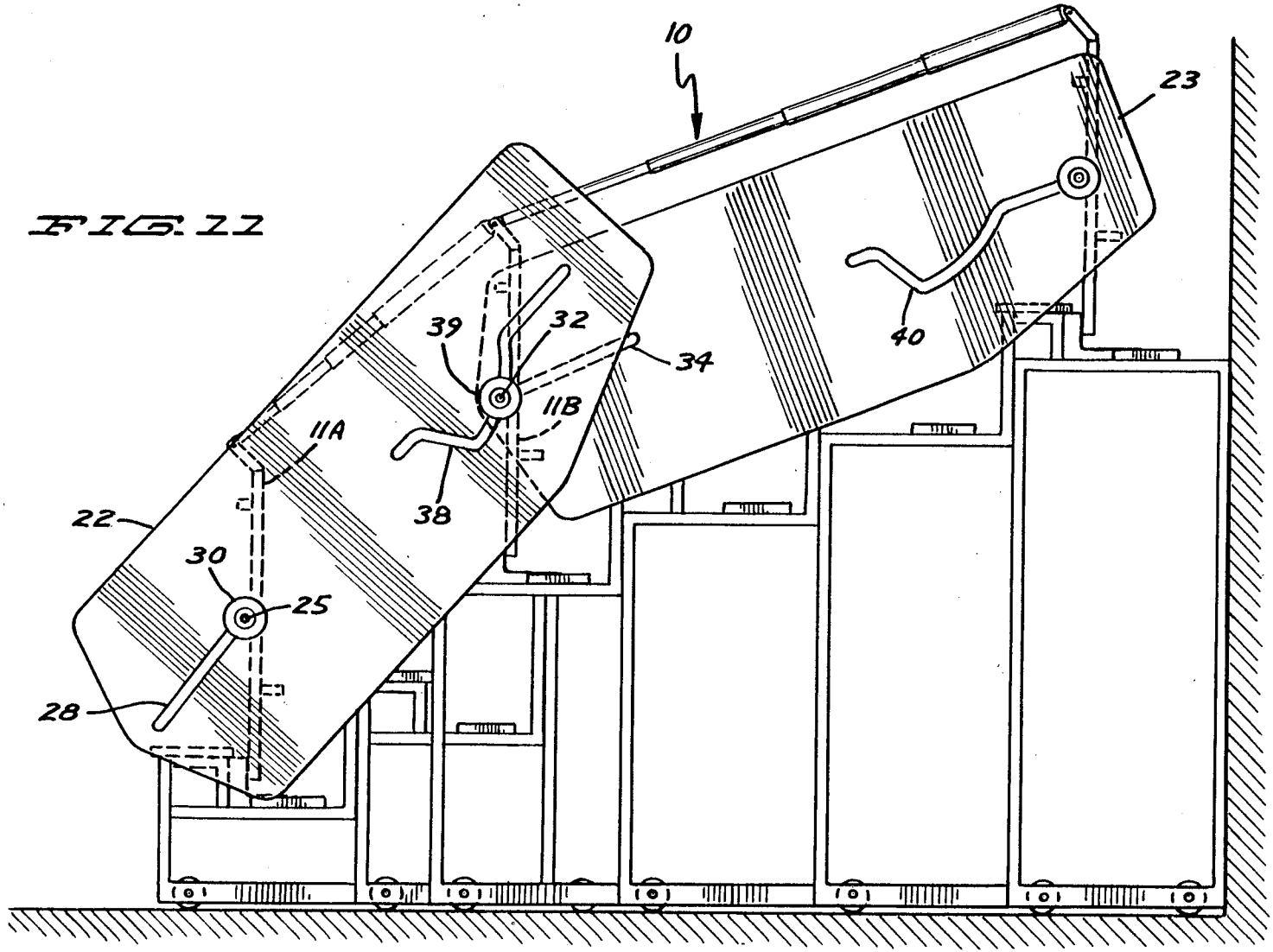

To provide greater stability, a latching means, as best shown in FIGS. 7 and 8, is provided for the rail assembly in its open position. A forwardly extending horizontal saber-like latch bar member 44 is welded or otherwise rigidly secured to each of the vertical support members 11 spaced from but adjacent to the upper ends thereof. With the rail assembly in its forwardmost position, latch member 44 engages a retainer bracket formed by strap 45 secured to the inside surface of each panel. An elongated horizontal guide and cushioning member 46 which extends through the strap 45 adjusts the spacing between the panel and vertical support and aligns and guides the latch member 44 into tight wedging engagement in the retainer bracket The guide member 46 may be formed from wood, for example The same latching mechanism is repeated adjacent the forward edge of each panel.

As best seen, for example, in FIGS. 5, 6, 7 and 9, vertical support members 11 are preferably formed from angle bar stock and positioned with their vertices and the ends of their sides lying in spaced apart parallel vertical planes which are parallel to the edges of the bleacher seats. Preferably the vertical support members are disposed with the vertices extending outwardly and the open angle formed by the sides of the angle stock facing inwardly. As seen, for example, in FIG. 1, the vertical supports are arranged in ascending order such that when the bleachers are collapsed, the top portion of support 11A overlaps the bottom portion of support 11B, the top portion of support 11B overlaps the bottom portion of 11C, etc. Because of the angle bar construction of the supporting posts, the overlapping portions of adjacent vertical supports nest together, thereby occupying minimum space in the collapsed bleacher assembly.

A preferred form of collapsible telescopic hand rail is shown in FIG. 14–17. The hand rail is provided with means for pivotal support at each end and is composed of multiple segments 16–19 of lessening diameters. According to the preferred structure, each telescoping joint between adjacent tubular sections includes a cylindrical internal bushing 50 in the end of the larger diameter tubular section Bushing 50 engages and guides the outer wall of the next adjacent tubular section of lesser diameter. Bushing 50 is formed from a synthetic resinous plastic material such as polyethylene, nylon, or the like. Bushing 50 has a beveled or champfered tapered outer end having a shoulder engaging the end of the tubular segment in which it is located. Thus, if a person using the bleachers slides his hand along the hand rail, the hand glides easily over adjacent hand rail sections without engaging the sharp edge of the larger of the tubular segments.

To lock the bushing 50 in place in the end of a tubular hand rail section, the outer wall of the bushing is preferably provided with a small bump or similar projection 52 which engages a hole 53 in the end of the hand rail section to firmly retain the bushing in place. To provide some resiliency to facilitate installation of the bushing, a narrow slot or slit 50A is provided in the bushing wall adjacent to projection 52.

As is common practice, the inside end of the tubular hand rail section of lesser diameter forming each telescopic joint is provided with a rolled externally projecting ring 54 on the outer surface of the tubular section. Ring 24 serves to guide movement of the tubular section of lesser diameter within the next adjacent tube of greater diameter and functions as a stop member to limit extension of the tubular sections. A cylindrical stop ring 55 is press fit or otherwise securely fastened within the tubular hand rail section of larger diameter Stop ring 55 functions as a bushing to guide and facilitate movement of the inner tubular section of lesser diameter and to limit the extension of that section by engagement with the rolled ring 54.

Figure 13:
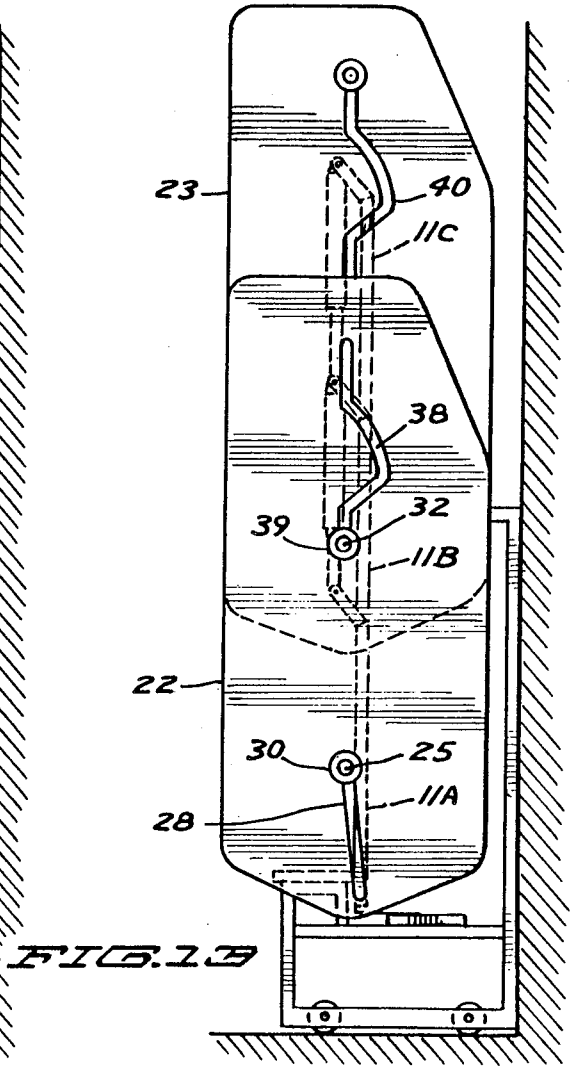
FIG. 13 is a similar side elevation showing the bleacher fully collapsed.
Figure 12:
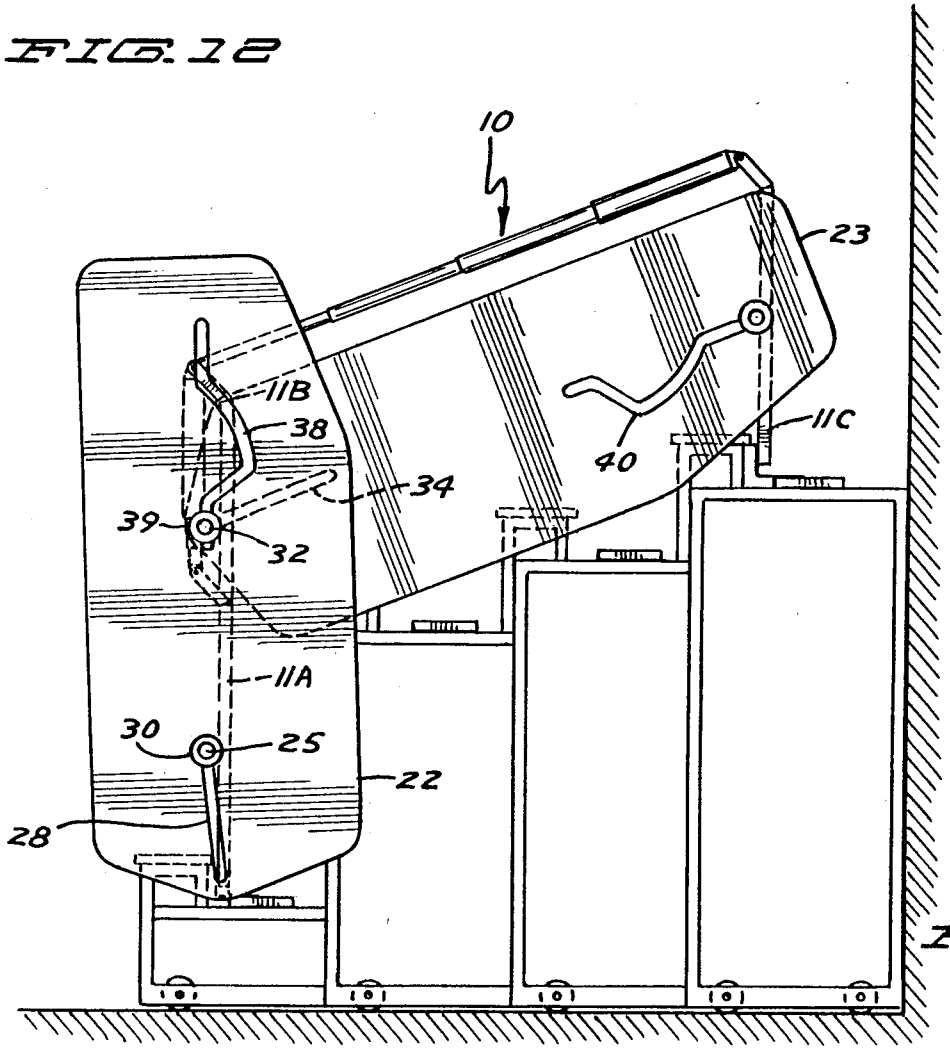
FIG. 12 is a similar side elevation showing the bleacher further collapsed.
Figures 24, 25, 26, 27, 28:
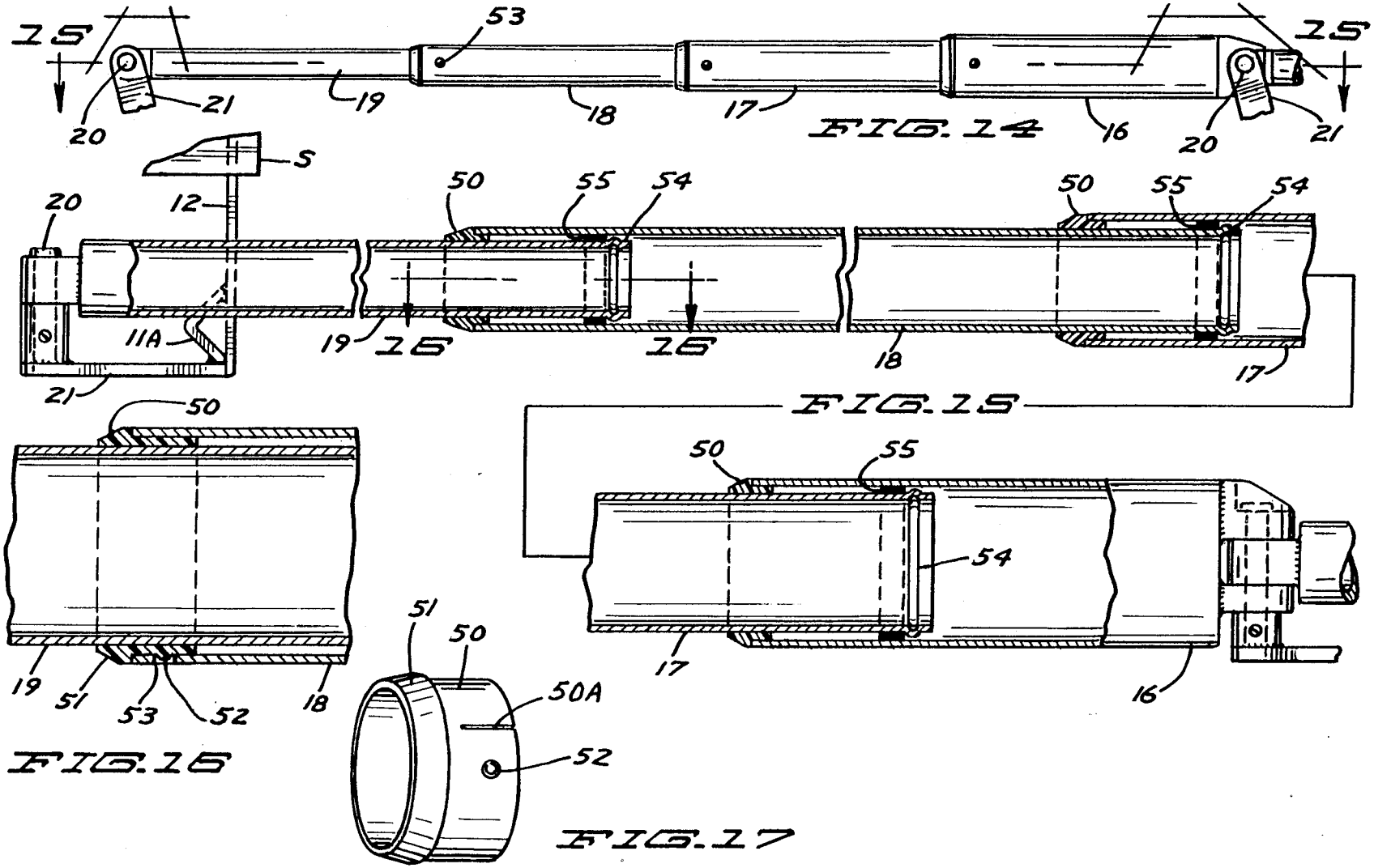

The manner in which the bleacher assembly is collapsed and the manner in which the hand rails and safety panels move relative to the vertical support members in the transition from fully open to collapsed position is seen by comparison of FIGS. 1 and 11 through 13. When the bleacher assembly is fully open, as seen in FIG. 1, roller 27 carried by pin 25 is at the lowermost end of cam slot 28 and roller 37 on pin 32 is at the uppermost end of cam slot 38 of panel 22. As collapse of the bleacher section is begun, vertical support members 11A and 11B, remaining in upright parallel vertical position, are moved toward one another. As this happens the telescopic hand rail collapses in the usual manner. As roller 24 on pin 25 moves in slot 28, panel 22 pivots on roller 37 on pin 32 such that panel 22 is rotated downwardly. When roller 24 reaches the end of slot 28, this then becomes the pivot point and roller 37 begins its movement in cam slot 38 as the vertical support members are moved closer together. An intermediate position is shown in FIG. 11. As the bleachers are collapsed further until vertical support members 11A and 11B come into abutment, as shown in FIG. 12, the procedure is then repeated with respect to panel 23. When fully collapsed, the panels are in vertical position as shown in FIG. 13.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A safety rail for a collapsible bleacher, said bleacher having opposite ends, said safety rail comprising:

(A) at least a pair of parallel spaced apart generally vertical support members positioned on at least one end of said bleacher, (B) means for attaching the lower ends of said support members in ascending spaced relation to said collapsible bleacher on said at least one end thereof, (C) a multi-section telescoping hand rail pivotally connected at each end to the top end of one of said support members, said hand rail and said support members defining an open space when the bleacher is extended, through which a patron may accidentally fall, (D) a rigid planar sheet material safety panel supported at each end thereof by said vertical members, said safety panel being of a size and shape to substantially fill the space between said vertical support members below said hand rail when said bleachers are in their extended state, whereby the likelihood of a patron accidentally falling from the end of a bleacher is prevented, and (E) means permitting relative rotational and longitudinal movement between said safety panel and support members upon collapse and extension of said bleachers.

2. A safety rail according to claim 1 wherein said means permitting relative movement between said safety panel and support members comprises:

(A) generally longitudinally extending cam slots in opposite ends of said panels, (B) a roller engageable in each of said slots, each of said rollers being journaled for rotation about a horizontal axis and supported by one of adjacent vertical support members intermediate of the ends thereof, and (C) retainer means holding said rollers in engagement with said slots.

3. A safety rail according to claim 2 wherein said retainer means comprises discs or washers on opposite sides of said rollers and engaging opposite sides of the panels adjacent to the edges of the cam slots.

4. A safety rail according to claim 1 wherein said safety panel is composed of transparent synthetic resinous sheet material.

5. A safety rail according to claim 1 wherein latch means are provided for firmly securing said panel and vertical support members in extended positions.

6. A safety rail according to claim 5 wherein said latch means comprises a saber-like bar member extending forwardly from said vertical support member, and a retainer bracket engageable by said bar member on the inside surface of said safety panel adjacent the forward edge thereof.

7. A safety rail according to claim 1 wherein said vertical support members are angle bars disposed with their vertices and ends of their sides lying in spaced apart parallel planes parallel to the edges of the bleacher seats, whereby upon collapse of the bleacher the vertical support members nest together.

8. A safety rail according to claim 7 wherein said vertices are outwardly facing.

9. A safety rail according to claim 1 wherein said telescopic hand rail comprises:

(A) a plurality of elongated telescoping tubular sections, and (B) a plurality of telescopic joints interconnecting adjacent tubular sections of greater and lesser diameters and including:

(1) an internal cylindrical first bushing at the end of the tubular section of greater diameter, the outer end of said bushing extending beyond the end of the tubular section and having a tapered surface, (2) an internal cylindrical stop ring and second bushing within the tubular section of greater diameter, spaced inwardly from said first bushing but adjacent to the end of the tubular section, the tubular section of lesser diameter being longitudinally movable within said bushings, and (3) stop means on the end of said tubular section of lesser diameter engageable with said stop ring to limit extension of the tubular sections.

10. A safety rail according to claim 9 wherein:

(A) the outermost end of said first bushing has an annular shoulder butting against the end of the tubular section of greater diameter, and (B) the external surface of said bushing tapers inwardly from said shoulder.

11. A safety rail for a collapsible bleacher, said bleacher having opposite ends, said safety rail comprising:

(A) at least a pair of parallel spaced apart generally vertical support members positioned on at least one end of said bleacher, said support members defining an open space when the bleacher is extended, through which a patron may accidentally fall, (B) means for attaching the lower ends of said support members in ascending spaced relation to said collapsible bleacher on said at least one end thereof, (C) a rigid planar sheet material safety panel supported at each end thereof by said vertical support members, the top edge of said panel comprising a hand rail, said safety panel being of a size and shape to extend above the tops of said vertical support members and to substantially fill the space between said support members when said bleachers are in their extended states, whereby the likelihood of a patron accidentally falling from the end of a bleacher is prevented, and (D) means permitting relative rotational and longitudinal movement between said safety panel and support members upon collapse and extension of said bleachers.

12. A safety rail according to claim 11 wherein said means permitting relative movement between said safety panel and support members comprises:

(A) generally longitudinally extending cam slots in opposite ends of said panels, (B) a roller engageable in each of said slots, each of said rollers being journaled for rotation about a horizontal axis and supported by one of adjacent vertical support members intermediate of the ends thereof, and (C) retainer means holding said rollers in engagement with said slots.

13. A safety rail according to claim 12 wherein said retainer means comprises discs or washers on opposite sides of said rollers and engaging opposite sides of the panels adjacent to the edges of the cam slots.

14. A safety rail according to claim 11 wherein (A) said vertical support members being angle bars disposed with their vertices and ends of their sides lying in spaced apart parallel planes parallel to said at least one end of the collapsible bleacher, whereby upon collapse of the bleacher the vertical support members nest together, and said hand rail being a multi-section telescoping hand rail pivotally connected at each end to the top end of one of said support members.

15. A safety rail according to claim 14 wherein said vertices are outwardly facing.

16. A telescoping hand rail for a collapsible bleacher comprising:

(A) a plurality or elongated telescoping tubular sections, (B) means at the ends of the endmost sections for pivotally attaching the hand rail to supports therefor, and (C) a plurality of telescopic joints interconnecting adjacent tubular sections of greater and lesser diameters and including:

(1) an internal cylindrical first bushing at the end of the tubular section of greater diameter, the outer end of said bushing extending beyond the end of the tubular section, and having a tapered surface, (2) an internal cylindrical stop ring and second bushing within the tubular section of greater diameter, spaced inwardly from said first bushing but adjacent to the end of the tubular section, the tubular section of lesser diameter being longitudinally movable within said bushing, and (3) stop means on the end of said tubular section of lesser diameter engageable with said stop ring to limit extension of the tubular sections.

17. A telescoping hand rail according to claim 16 wherein:

(A) the outermost end of said first bushing has an annular shoulder butting against the end of the tubular section of greater diameter, and (B) the external surface of said bushing tapers inwardly from said shoulder.

18. A telescoping hand rail according to claim 17 wherein:

(A) said first bushing is composed of synthetic resinous semi-rigid plastic material, (B) a projecting bump is provided on the outside wall of said bushing spaced inwardly from said shoulder, and (C) a correspondingly positioned hole is provided in the wall of the tubular section of greater diameter to receive said projecting bump to retain said bushing in place.

19. A telescoping hand rail according to claim 18 wherein a longitudinal slit is provided in the wall of said bushing adjacent to the inner end thereof and adjacent to said projecting bump.

* * * * *

UNITED STATES PATENT AND TRADEMARK OFFICE

CERTIFICATE OF CORRECTION

PATENT NO. : 4,997,165

DATED : March 5, 1991

INVENTOR(S) : Harold Wiese

It is certified that error appears in the above-identified patent and that said Letters Patent is hereby corrected as shown below:

Col. 2, line 36, after "F" insert a period --- . ---.

Col. 3, line 33, after "assembly" insert a period --- . ---.

Col. 3, line 62, after "bracket" insert a period --- . ---.

Col. 3, line 63, after "example" insert a period --- . ---.

Col. 4, line 23, after "section" insert a period --- . ---.

Col. 4, line 46, "Ring 25" should be ---Ring 54---.

Col. 4, line 51, after "diameter" insert a period --- . ---.

Col. 7, line 21, delete "(A)".

Col. 7, line 35, "or" should be --- of ---.

Signed and Sealed this

Twenty-second Day of September, 1992

*Attest:*

DOUGLAS B. COMER

*Attesting Officer*

*Acting Commissioner of Patents and Trademarks*